US006465974B2

(12) United States Patent
Watanabe

(10) Patent No.: US 6,465,974 B2
(45) Date of Patent: Oct. 15, 2002

(54) AIR INTAKE AMOUNT CONTROL APPARATUS FOR AN ENGINE

(75) Inventor: Shinji Watanabe, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/741,189

(22) Filed: Dec. 21, 2000

(65) Prior Publication Data

US 2001/0019252 A1 Sep. 6, 2001

(30) Foreign Application Priority Data

Dec. 28, 1999 (JP) ..... 11-373810

(51) Int. Cl.[7] ..... H02K 23/00

(52) U.S. Cl. ..... 318/254; 318/138; 318/439; 318/599

(58) Field of Search ..... 318/138, 254, 318/439, 599; 123/192.1, 399; 701/85, 87; 180/197

(56) References Cited

U.S. PATENT DOCUMENTS 4,779,592 A * 10/1988 Takeuchi et al. ..... 123/399
5,428,541 A * 6/1995 Miyata et al. ..... 180/197
5,828,193 A 10/1998 Furuta ..... 318/254
6,148,784 A * 11/2000 Masberg et al. ..... 123/192.1

FOREIGN PATENT DOCUMENTS

JP 1-315641 12/1989
JP 5-240070 9/1993

* cited by examiner

*Primary Examiner*—Khanh Dang
(74) *Attorney, Agent, or Firm*—Sughrue Mion, PLLC

(57) ABSTRACT

Even when a vehicle engine is started after replacement of a throttle actuator or the like without learning a magnetic pole position of a rotor of a brushless motor for driving a throttle valve, engine power can be controlled in a proper manner so that the vehicle can be driven to travel in a safety mode. An air intake amount control apparatus for an engine is equipped with a throttle valve mounted on a rotation shaft in an air intake passage of the engine, a motor having a rotor coupled to the rotation shaft, and a throttle sensor for sensing an opening degree of the throttle valve, so that the throttle valve is controlled by the motor based upon various sorts of engine operating information. The apparatus further includes a rotor magnetic pole position learning unit for driving the motor in a stepwise manner so as to learn a magnetic pole position of the rotor detected by the throttle sensor, a rotor magnetic pole position learned value storing unit for storing therein the rotor magnetic pole position learned value, and a magnetic pole position identifying unit for driving the motor to a predetermined stepwise position so as to identify the magnetic pole position learned value stored in the rotor magnetic pole position learned value storing unit with the magnetic pole position of the motor detected by the throttle sensor.

17 Claims, 8 Drawing Sheets

ENERGIZING PATTERN No.1

ENERGIZING PATTERN No.4

ENERGIZING PATTERN No.2

ENERGIZING PATTERN No.5

ENERGIZING PATTERN No.3

ENERGIZING PATTERN No.6

FIG. 8

TABLE:1. STEPWISE DRIVE ENERGIZING PATTERNS

| ENERGIZING PATTERN | MAGNETIC POLE PATTERNS FOR RESPECTIVE PHASES | | | THROTTLE OPENING DRIVE | THROTTLE CLOSING DRIVE |
|---|---|---|---|---|---|
| | U PHASE | V PHASE | W PHASE | | |
| NO.1 | N POLE | S POLE | N POLE | ↓ | ↑ |
| NO.2 | N POLE | S POLE | S POLE | | |
| NO.3 | N POLE | N POLE | S POLE | | |
| NO.4 | S POLE | N POLE | S POLE | | |
| NO.5 | S POLE | N POLE | N POLE | | |
| NO.6 | S POLE | S POLE | N POLE | | |

AIR INTAKE AMOUNT CONTROL APPARATUS FOR AN ENGINE

CROSS REFERENCE TO RELATED APPLICATION

This application is based on application Ser. No. 11-373810, filed in Japan on Dec. 28, 1999, the contents of which are hereby incorporated by reference.

BACKGROUND OF THE INVENTION

1. Field of the Invention

The present invention relates to an air intake amount control apparatus for an engine, capable of controlling the intake amount of air supplied to the engine by means of a throttle valve which is driven to rotate by a motor.

2. Description of the Prior Art

In general, an internal combustion engine mounted on a vehicle is equipped with a throttle valve in an air intake path which is opened and closed in conjunction with a manipulation of an accelerator pedal by a vehicle driver. As a result, the amount of air sucked into the engine is controlled in accordance with the quantity of manipulation of the accelerator pedal.

Such an air intake amount control operation may be achieved by jointly coupling the throttle valve to the accelerator pedal by way of a mechanical coupling such as a link mechanism, a cable or the like.

However, the air intake amount control using such a mechanical coupling is suffered from the following problems. That is, the relationship between the push amount or the amount of depression of the accelerator pedal and the throttle opening degree is uniquely determined without any degree of freedom. Also, since the positional relationship between the accelerator pedal and the throttle valve is limited, freedom in mounting the mechanical coupling member on the vehicle is reduced.

Very recently, the need of freely controlling engine power is increasing for the purposes of improving an air intake amount control device for a gasoline direct injection type engine in which gasoline is directly injected into cylinders of the engine, also of improving stability in maneuverability of the vehicle as well as the sensation in acceleration. To fulfil such a need, an electronically controlled throttle device that is actualized by using a so-called "Drive By Wire" technique may constitute one of the most effective air intake amount control devices.

The electronically controlled throttle device is designed to control a throttle valve by using the "Drive By Wire" technique while discarding the use of the above-mentioned accelerator cable, the amount of depression of the accelerator pedal is electrically detected so that the throttle valve is accordingly driven to move by the motor. As a result, the throttle valve can be operated independent of the driver's accelerator pedal manipulation, thus allowing the engine power to be controlled freely.

In a gasoline direct-injection type engine, an air-to-fuel ratio is changed over a wide range from a stoichiometric air-to-fuel ratio (stoichiometric A/F ratio) up to an ultra lean (ultra lean A/F ratio). However, there is a large difference between the torque produced during a stoichiometric A/F ratio drive operation and the torque produced during a ultra lean A/F ratio drive operation even at the same throttle opening degree. To suppress a torque variation occurring when the air-to-fuel ratio is switched between the ultra lean A/F ratio drive operation and the stoichiometric A/F ratio drive operation, the air intake amount is required to be corrected.

To solve these problems, an electronically controlled throttle device is employed.

Furthermore, Japanese Patent Application Laid-Open No. 5-240070, which was laid open to public in 1993, discloses a throttle valve control system capable of achieving a highly precise opening-degree control characteristic of a throttle valve by coupling the rotor of a brushless motor via a speed reducer or a reduction gear to the rotation shaft of the throttle valve.

Also, with this throttle valve control system, a counter electromotive voltage detector or a current switching detector is provided for detecting a counter electromotive voltage that is produced in the stator windings (hereinafter referred to as "phases") of the brushless motor when the phases of the brushless motor are switched from one to another. As a result, such an expensive high-precision rotary detector as referred to above can be omitted.

However, the above-mentioned conventional engine air intake amount control for controlling the throttle valve involves the following problems.

First, in order to switch the energizing phase of the brushless motor, either the counter electromotive voltage detector or the current detector is required, so that it becomes necessary to increase the signal input I/F of a motor control apparatus, thus resulting in high cost. Also, in the counter electromotive voltage detecting system, a counter electromotive voltage can be detected only when the brushless motor is rotating at a speed not less than a predetermined speed. Accordingly, it becomes difficult to detect the counter electromotive voltage in such a condition that the stationary/rotational operations are frequently repeated as in the throttle valve control.

Also, when the energizing phase is switched based on an output derived from a throttle sensor, there might occur a positional shift in the energizing phase switching positions caused by the allowances in the characteristics of the speed reducer and the throttle sensor.

Furthermore, in operation of the brushless motor, when a certain energizing phase is switched to a next energizing phase based on the output derived from the counter electromotive voltage detector or the current switching detector, the current is rapidly changed so that in cases where there is a shift or deviation in the output signal of any of the detectors with respect to a change in the magnetic flux applied to the phase, the torque produced by the motor becomes discontinuous. Thus, there arises a problem that the throttle opening degree is rapidly changed. As a result, a 3-phase energizing system may be employed in which the energizing currents having sine waves are respectively supplied to the U-phase, V-phase and W-phase, independently of each other. However, such a 3-phase energizing system has the following problem. That is, a detector capable of precisely measuring the rotation angle of the rotor of a motor is required.

As a consequence, the following energizing phase control system for the 3-phase windings is conceivable. In this control system, when a key switch is turned off, a brushless motor is driven stepwise so as to learn a geometric positional relationship between a rotor magnetic pole position and a stator based upon a sensor output signal of a throttle sensor; the resulting learned value is stored into a battery-backed-up memory such as a RAM and a non-volatile memory such as an EEPROM. When the key switch is turned on, a motor energizing phase angle at which a corresponding motor is energized is calculated based on both the output value of the throttle sensor and the rotor magnetic pole position learned value.

Let us consider the case where such a 3-phase winding energizing phase control system is applied to an actuator in which a throttle valve is held at an intermediate opening position when a motor for actuating the throttle valve is not energized. In this case, if a key switch is turned on to start the motor without previously performing the above-described rotor magnetic pole position learning operation after some component parts of the actuator have been replaced, then the rotor magnetic pole position learned value becomes unmatched with the actual rotor magnetic pole position of the actuator after the replacement of the actuator component parts. As a result, control on the throttle opening cannot be carried out by driving the motor. Thus, the engine is started with the throttle valve being opened and fixed at the intermediate opening position, and hence if the control apparatus cannot recognize this uncontrollable condition of the throttle valve, then there will result problems such as an abnormal increase in the engine revolution and the like.

SUMMARY OF THE INVENTION

The present invention is intended to obviate the aforementioned problems, and thus, has an object to provide an air intake amount control apparatus for an engine which is low in cost, and excellent in safety as well as controllability.

Bearing the above object in mind, according to the present invention, there is provided an air intake amount control apparatus for an engine comprising: a throttle valve mounted on a rotation shaft in an intake passage of the engine; a throttle sensor for sensing an opening degree of the throttle valve; a motor having a rotor coupled to the rotation shaft for driving the throttle valve based upon various sorts of engine operating information; a rotor magnetic pole position learning unit for driving the motor in a stepwise manner so as to learn a magnetic pole position of the rotor that is detected by the throttle sensor; a rotor magnetic pole position learned value storing unit for storing therein the magnetic pole position of the rotor learned by the rotor magnetic pole position learning unit as a magnetic pole position learned value; and a magnetic pole position identifying unit for driving the motor to a predetermined stepwise position so as to identify the magnetic pole position learned value stored in the rotor magnetic pole position learned value storing unit with the magnetic pole position of the motor at the predetermined stepwise position detected by the throttle sensor.

In a preferred form of the invention, a magnetic pole position learning operation of the rotor magnetic pole position learning unit is performed when a key switch is turned off.

In another preferred form of the invention, a magnetic pole position identifying operation of the rotor magnetic pole position identifying unit is performed when a key switch is turned on.

In a further preferred form of the invention, the air intake amount control apparatus for an engine further comprises an intermediate opening degree stopping mechanism for setting the opening position of the throttle valve to an intermediate opening degree position under such a condition that the motor is not energized when a key switch is turned on, wherein a magnetic pole position identifying operation of the rotor magnetic pole position identifying unit is carried out by driving the rotor in a stepwise manner from the intermediate opening degree position to a first rotor magnetic pole position learning position in a throttle fully-closed direction.

In a yet further preferred form of the invention, the rotor magnetic pole position identifying unit judges that the rotor magnetic pole position learned value stored in the rotor magnetic pole position learned value storing unit is not coincident with the magnetic pole position of the motor if a deviation between the rotor magnetic pole position learned value and the rotor magnetic pole position detected by the throttle sensor when the rotor is stepwise driven to a predetermined rotor magnetic pole position learning position upon turning on of a key switch is larger than, or equal to, a predetermined value.

In a further preferred form of the invention, when the rotor magnetic pole position identifying unit judges that the rotor magnetic pole position learned value is not coincident with the magnetic pole position of the motor detected by the throttle sensor, the rotor magnetic pole position identifying unit prohibits the execution of the throttle opening degree control operation until the key switch is turned off, judges that a position feedback failure happens to occur, gives a warning, and sets the throttle opening degree to the intermediate opening degree position.

In a further preferred form of the invention, a magnetic pole position identifying operation of the rotor magnetic pole position identifying unit is prohibited when a battery voltage is lower than, or equal to, a predetermined value.

In a further preferred form of the invention, a magnetic pole position identifying operation of the rotor magnetic pole position identifying unit is prohibited when the opening position of the throttle valve is without a predetermined range immediately after a key switch is turned on.

In a further preferred form of the invention, when the rotor magnetic pole position learning operation is not yet performed, the rotor magnetic pole position identifying unit prohibits the execution of the throttle opening degree control operation, prohibits the throttle opening degree control operation until the key switch is turned off, judges that a position feedback failure happens to occur, gives a warning, and sets the throttle opening degree to the intermediate opening degree position.

In a further preferred form of the invention, the rotor magnetic pole position learned value storing unit comprises: a volatile memory being energized by a battery to hold a storage operation; and a non-volatile memory. When a key switch is turned on with the battery having not been disconnected from the volatile memory, the rotor magnetic pole position identifying unit executes a rotor magnetic pole position identifying operation by using a magnetic pole position learned value stored in the volatile memory, whereas when the key switch is turned on just after the battery is disconnected from the volatile memory, the rotor magnetic pole position identifying unit executes a rotor magnetic pole position identifying operation by using the magnetic pole position learned value stored in the non-volatile memory.

In a further preferred form of the invention, the rotor magnetic pole position learning unit learns a fully-closed position of the throttle valve based upon the voltage value outputted from the throttle sensor when a voltage value outputted from the throttle sensor upon the rotor being stepwise driven from the throttle intermediate opening degree position in a throttle fully-closed direction is smaller than, or equal to, a predetermined voltage value, and when a deviation between a first voltage value outputted from the throttle sensor at a preceding stepwise position of the throttle valve and a second voltage value outputted from the throttle sensor at a present stepwise position of the throttle valve is smaller than, or equal to, a predetermined value.

In a further preferred form of the invention, the rotor magnetic pole position learning unit learns a fully-opened position of the throttle valve based upon the voltage value outputted from the throttle sensor when a voltage value outputted from the throttle sensor upon the rotor being stepwise driven from the throttle fully-closed opening degree position in a throttle fully-opened direction is greater than, or equal to, a predetermined voltage value, and when a deviation between a first voltage value outputted from the throttle sensor at a preceding stepwise position of the throttle valve and a second voltage value outputted from the throttle sensor at a present stepwise position of the throttle valve is smaller than, or equal to, a predetermined value.

In a further preferred form of the invention, when the throttle sensor detects either the fully-closed position or the fully-opened position of the throttle valve, the direction in which the rotor is stepwise driven is reversed by switching over energizing patterns.

BRIEF DESCRIPTION OF THE DRAWINGS

For a better understanding of the present invention, reference is made of a detailed description to be read in conjunction with the accompanying drawings, in which:

FIG. 8 is a table for indicating a stepwise drive pattern used in the air intake amount control apparatus of the invention.

DETAILED DESCRIPTION OF THE PREFERRED EMBODIMENTS

Now, preferred embodiments of the present invention will be described in detail while referring to the accompanying drawings.

Embodiment 1

Figure 1:
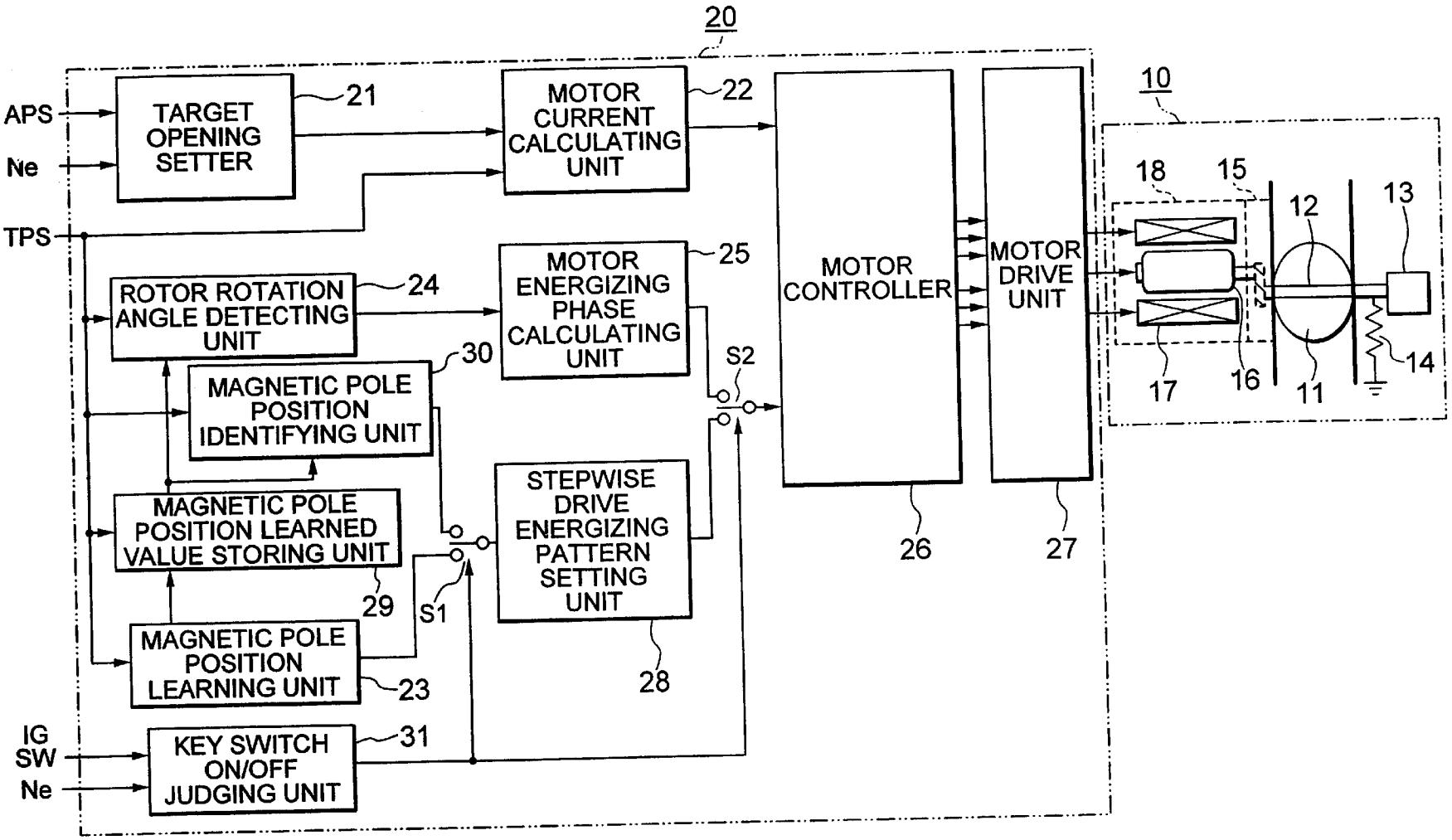
FIG. 1 is a structural diagram for illustratively showing an arrangement of an air intake amount control apparatus for an internal combustion engine according to the present invention.

FIG. 1 schematically shows an arrangement of an air intake amount control apparatus for a vehicular internal combustion engine in accordance with a first embodiment of the present invention.

The engine air intake amount control apparatus, generally designated at reference numeral 20 in FIG. 1, serves to control a throttle actuator 10 capable of regulating the amount of intake air sucked into an internal combustion engine (not shown) which is adapted to be mounted on a vehicle such as a motor car. The throttle actuator 10 comprises a throttle valve 11 fixedly secured to a rotation shaft 12 rotatably mounted on an intake pipe or passage, a throttle sensor 13 for sensing the opening degree or angle of the throttle valve 11 and generating a corresponding output signal, a return spring 14 connected at its one end to the rotation shaft 12 and a stationary portion of the engine for biasing the throttle valve toward its initial or intermediately opened position, and a brushless motor 18 coupled to the rotation shaft 12 through a speed reduction gear for driving the rotation shaft 12 and hence the throttle valve 12 to rotate in unison. The throttle valve 11 is driven to rotate by means of the motor 18 to change the opening area of the intake pipe. The throttle sensor 13 is provided on one end of the rotation shaft 12 for sensing the rotation angle (i.e., throttle opening degree) of the rotation shaft 12. The return spring 14 connected to the rotation shaft 12 at its one end serves to urge the throttle valve 11 either in an opening direction or in a closing direction such that the throttle valve 11 is caused to rotate to the initial position (i.e., an intermediate angle position). The brushless motor 18 has a rotor 16 and a stator winding 17. The rotor 16 is coupled via a speed reducer 15 in the form of a reduction gear to the stator winding 17. This speed reducer 15 is provided on the rotation shaft 12 at the other end thereof.

The air intake amount control apparatus 20 for controlling the throttle actuator 10 includes a target opening setter 21, a motor current calculating unit 22, a rotor magnetic pole position learning unit 23, a rotor magnetic pole position learned value storing unit 29, a rotor rotation angle detecting unit 24, a motor energizing phase calculating unit 25, a motor controller 26, a motor drive unit 27, a stepwise drive energizing pattern setting unit 28, a magnetic pole position identifying unit 30, and a key switch on/off judging unit 31. The target opening setting unit 21 calculates a target throttle opening degree "$\theta_0$" for the throttle valve 12 based on various kinds of vehicle drive information such as an accelerator opening degree sensor (APS) input, an engine revolution number (rpm), a vehicle speed, and a water temperature of water or coolant for cooling the engine. The motor current calculating unit 22 calculates a motor phase current based upon an opening degree deviation "$\Delta\theta$" between the target throttle opening degree "$\theta_0$" and an actual throttle opening degree "$\theta_r$". This actual throttle opening degree corresponds to an input signal derived from the throttle sensor (TPS) 13. The rotor magnetic pole position learning unit 23 learns a magnetic pole position relationship between the stator 17 and the rotor 16, which is sensed by the throttle sensor 13 by driving the brushless motor 18 in a stepwise manner. The rotor magnetic pole position learned value storing unit 29 stores the learned value obtained by the rotor magnetic pole position learning unit 23. The rotor rotation angle detecting unit 24 acquires a rotation angle of the rotor 16 based upon both the sensor output of the throttle sensor 13 and the learned value stored in the rotor magnetic pole position learned value storing unit 29. The motor energizing phase calculating unit 25 separately calculates energizing ratios of the respective stator windings 17 under energizing condition based upon the rotation angle of the rotor detected by the rotor rotation angle detecting unit 24. The motor controller 26 outputs a PMW duty corresponding to a current of each of these stator windings 17 under energizing condition based upon both the current value of the motor current calculating unit 22 and the energizing ratio derived from the motor energizing phase calculating unit 25. The motor drive unit 27 supplies a motor current to the brushless motor 18 in response to the drive signal derived from the motor controller 26. The stepwise drive energizing pattern setting unit 28 energizes the respective stator windings 17 of the brushless motor 18 in accordance with a predetermined energizing pattern so as to drive the brushless motor 18 in a stepwise manner. The magnetic pole position identifying unit 30 identifies as to whether or not a rotor magnetic pole position is made identical to the magnetic pole position learned value stored in the rotor magnetic pole position learned value storing unit 29. This rotor magnetic pole position corresponds to such a sensor output value of the throttle sensor 13 in such a case that when the key switch is turned on, the rotor 16 is driven by the stepwise drive energizing pattern setting unit 28 at a predetermined magnetic pole position stored in the rotor magnetic pole position learned value storing unit 29. The key switch on/off judging unit 31 receives both an ignition (IG) switch signal and an engine revolution speed signal "Ne" so as to judge whether or not the key switch is turned on/off. It should be noted that the rotor magnetic pole position learned value storing unit 29 is equipped with a volatile memory which is powered by a battery to hold its storage operation, and a non-volatile memory. The magnetic pole position identifying unit 30 identifies the magnetic pole positions in the following manner; in cases where the key switch is turned on under such a condition that the battery is not disconnected from the volatile memory, the magnetic pole position learned value stored in the volatile memory is used to identify the magnetic pole positions, whereas in cases where the key switch is turned on just after the battery is disconnected from the volatile memory, the magnetic pole position learned value stored in the non-volatile memory is used to identify the magnetic pole positions.

It should also be noted that when the key switch on/off judging unit 31 judges that the key switch is turned off, the switch S1 is operated by an output signal from the key switch on/off judging unit 31 to alternatively connect the stepwise drive energizing pattern setting unit 28 with the rotor magnetic pole position learning unit 23 so that the energizing pattern set by the stepwise drive energizing pattern setting unit 28 is read by the rotor magnetic pole position learning unit 23. As a result, the rotor magnetic pole position learning unit 23 operates such that the rotor magnetic pole position learned value storing unit 29 stores such a throttle opening degree voltage value supplied to the brushless motor 18 at each of stepwise positions when the throttle valve 11 is stepwise driven in a direction toward the fully closed position thereof in accordance with the energizing pattern.

Also, when the key switch on/off judging unit 31 judges that the key switch is turned on, the switch S1 is switched to connect the stepwise drive energizing pattern setting unit 28 with the magnetic pole position identifying unit 30 so that the energizing pattern set by the stepwise drive energizing pattern setting unit 28 is read out by the magnetic pole position identifying unit 30. As a result, the magnetic pole position identifying unit 30 identifies a current magnetic pole position learned value, which is read out from the rotor magnetic pole position learned value storing unit 29 and is the nearest to the throttle fully-closed position, with a corresponding energizing pattern that is driven by the magnetic pole position learned value read out from the stepwise drive energizing pattern setting unit 28.

Regarding the switch S2, when the key switch on/off judging unit 31 judges that the key switch is turned off, the switch S2 is operated to connect the stepwise drive energizing pattern setting unit 28 to the motor controller 26 in order to supply the energizing pattern from the unit 28 to the motor controller 26. As a result, a motor drive signal corresponding to the energizing pattern is outputted from the motor controller 26 to the motor drive unit 27.

Also, when the key switch on/off judging unit 31 judges that the key switch is turned on, the switch S2 is switched over to connect the motor energizing phase calculating unit 25 to the motor controller 26, so that the unit 25 outputs to the motor controller 26 a PWM duty corresponding to the magnitude of current to be supplied to each of the energizing stator windings 17, the magnitude of current being calculated by the motor energizing phase calculating unit 25 based upon the rotation angle of the rotor obtained by the rotor rotation angle calculating unit 24.

Figure 2:
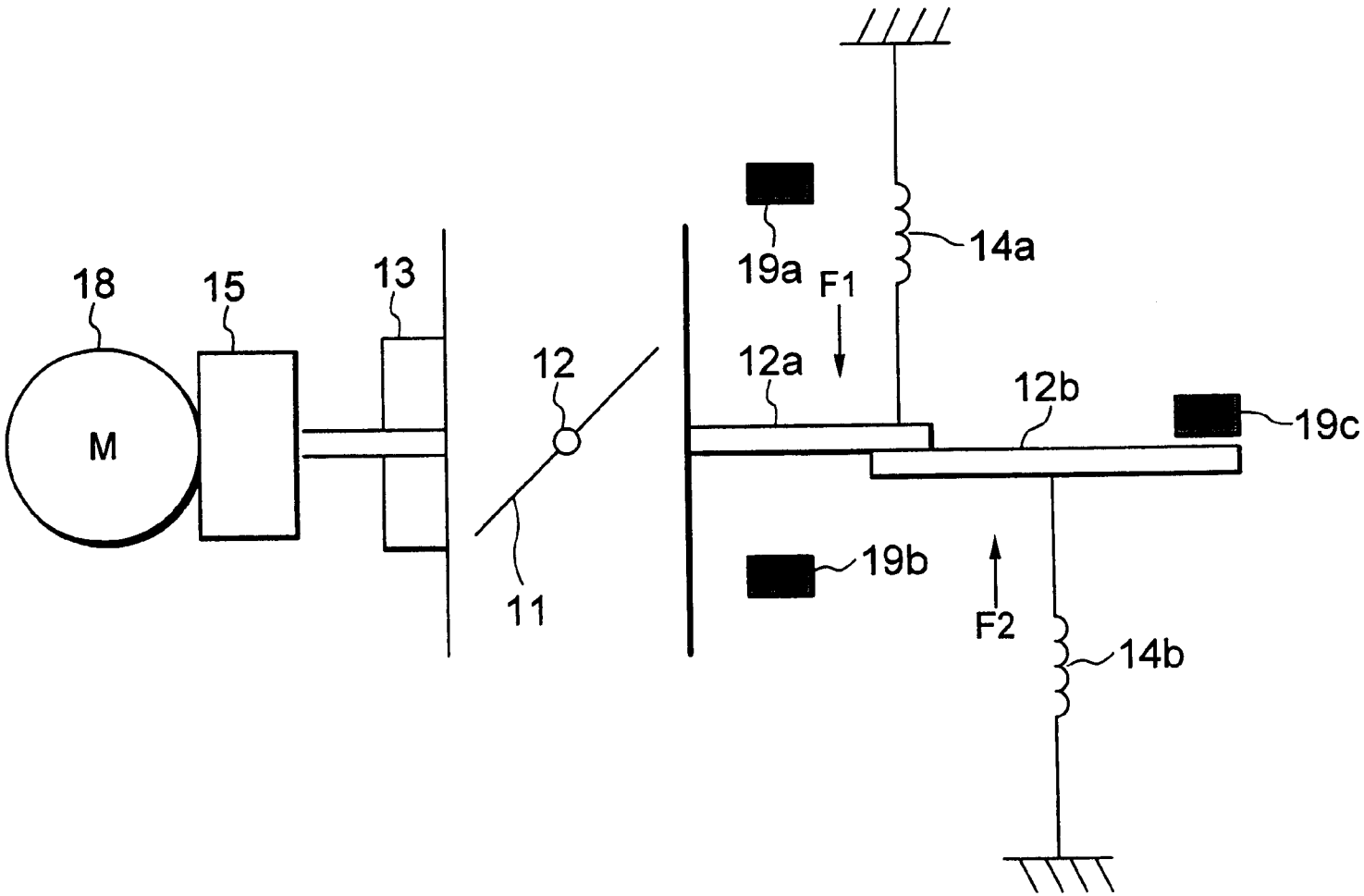
FIG. 2 is a structural diagram for schematically showing a throttle actuator equipped with an intermediate opening stopping mechanism, employed in the air intake amount control apparatus of the invention.

FIG. 2 schematically shows the construction of a throttle actuator equipped with an intermediate opening degree stopping mechanism employed in the engine air intake amount control apparatus according to the first embodiment. The drive force produced by the brushless motor 18 is transmitted to the throttle valve rotation shaft 12 for supporting the throttle valve 11 via the speed reducer 15. A valve lever 12*a* is coupled to the throttle valve rotation shaft 12. A biasing force "F1" is applied to the valve lever 12*a* by a throttle return spring 14*a* so as to energize the throttle valve 11 toward the fully-closed direction.

A throttle valve opener 12*b* serves to urge the throttle valve 11 in its fully opened direction under the action of a biasing force "F2" of a Limp home travelling spring 14*b*. A relationship between the biasing force F1 of the throttle return spring 14*a* and the biasing force F2 of the Limp home travelling spring 14*b* is set to be F1<F2. As a result, when the brushless motor 18 is under non-energizing condition, the throttle valve opener 12*b* is depressed against the intermediate opening degree position stopper 19*c* by means of the biasing force F2 of the Limp home travelling spring 14*b*. As a result, the throttle valve 11 is stopped at an intermediate opening degree position, thus allowing the Limp home travelling operation to be performed.

During the time when the throttle valve 11 is opened/closed by way of the brushless motor 18, the rotation of the throttle valve lever 12*a* is restricted by both a fully opening stopper 19*a* and a fully closing stopper 19*b*, so that both a fully opened throttle position and a fully closed throttle position may be determined or limited.

Figure 3:
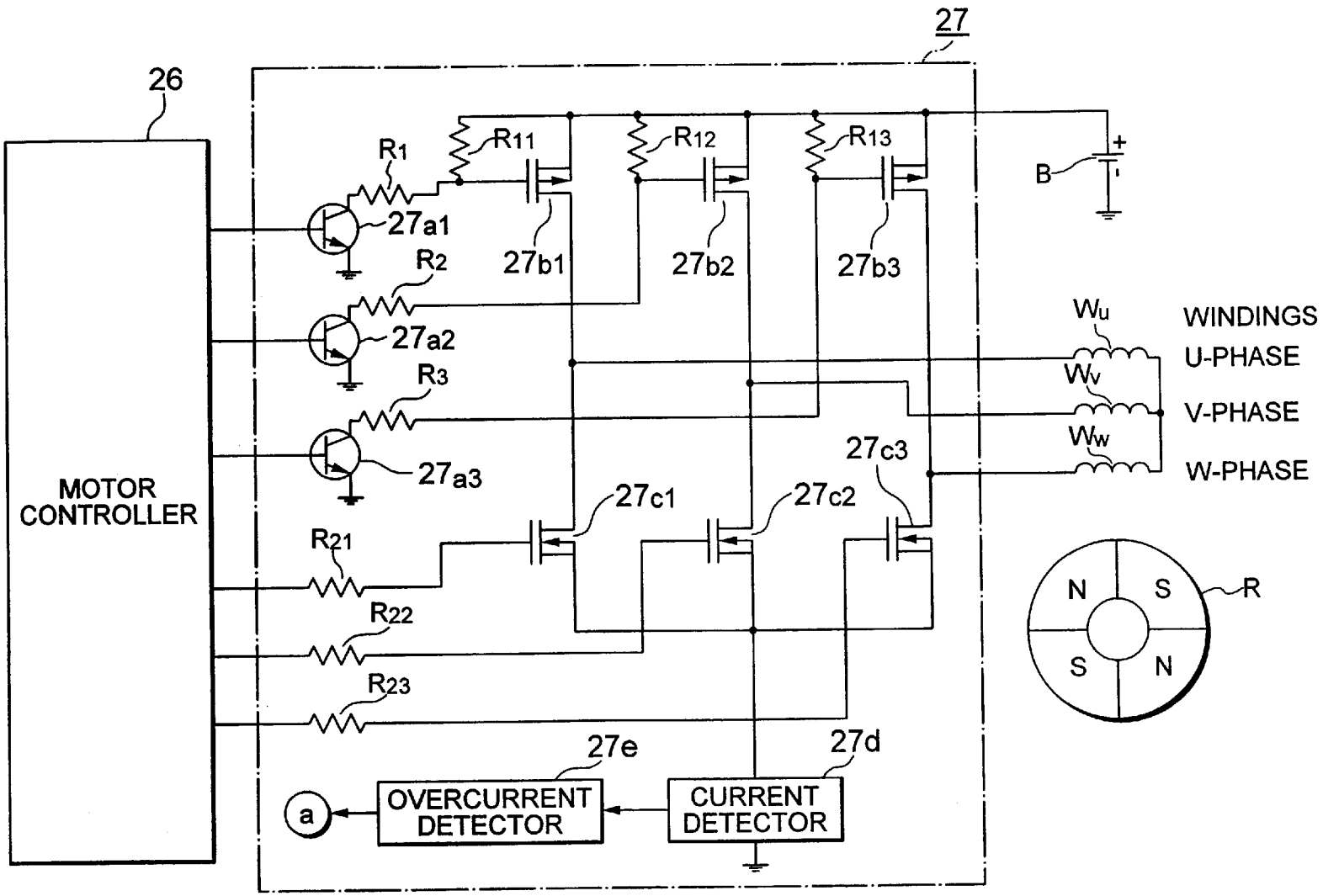
FIG. 3 is an illustration of a detailed structure of a motor drive unit employed in the air intake amount control apparatus of the invention.

FIG. 3 is a detailed arrangement diagram of the motor drive unit 27. The motor drive unit 27 supplies a current to the stator winding 17 of the brushless motor 18 in response to a drive signal from the motor controller 26. The motor drive unit 27 includes a pre-stage group of switching elements 27*a*1 to 27*a*3; a final-stage group of switching elements 27*b*1 to 27*b*3; a downstream-side group of final-stage switching elements 27*c*1 to 27*c*3; a current detector 27*d* for detecting currents flowing through stator windings Wu, Wv, and Ww, and an overcurrent detector 27*e* for detecting an overcurrent based upon the current detected by the current detector 27*d*. The pre-stage switching elements 27*a*1 to 27*a*3 serves to drive an upstream-side drive stage of a 3-phase bridge circuit. An output of the overcurrent detector 27*e* is inputted to the motor controller 26. When the overcurrent detector 27*e* detects an overcurrent, the overcurrent detector 27*e* turns off the motor drive signal so as to prevent the occurrence of such an overcurrent. The stator windings Wu, Wv, and Ww of the brushless motor 18 are connected via the final-stage group of switching elements 27*b*1 to 27*b*3 and the downstream-side final stage group of switching elements 27*c*1 to 27*c*3 between a battery B and ground.

In operation, the motor controller 26 makes the pre-stage switching elements 27*a*1 and 27*a*2 conductive so as to turn on the final-stage switching elements 27*b*1 and 27*b*2. Also, the motor controller 26 turns on the downstream-side final-stage switching element 27*c*3 in response to the control signal supplied from the motor controller 26, so that a current may flow from the U-phase winding Wu to the W-phase winding Ww and also another current may flow from the V-phase winding Wv to the W-phase winding Ww. As a result, a magnetic field distribution within the brushless motor 18 is changed so that the rotor 16 is caused to rotate by a predetermined angle.

Subsequently, the motor controller 26 makes the pre-stage switching element 27*a*1 conductive so as to turn on the final-stage switching element 27*b*1. Also, the motor controller 26 turns on the downstream-side final-stage switching elements 27*c*2 and 27*c*3 in response to the control signal supplied from the motor controller 26, so that a current may flow from the U-phase winding Wu to the W-phase winding Ww and also another current may flow from the U-phase winding Wu to the V-phase winding Wv. As a result, a magnetic field distribution within the brushless motor 18 is changed so that the rotor 16 is caused to further rotate by a predetermined angle.

Furthermore, the motor controller 26 makes the pre-stage switching elements 27*a*1 and 27*a*3 conductive so as to turn on the final-stage switching elements 27*b*1 and 27*b*3. Also, the motor controller 26 turns on the downstream-side final-stage switching element 27*c*2 in response to the control signal supplied from the motor controller 26, so that a current may flow from the W-phase winding Ww to the V-phase winding Wv and also another current may flow from the W-phase winding Ww to the V-phase winding Wv. As a result, a magnetic field distribution within the brushless motor 18 is changed so that the motor 16 is caused to further rotate by a predetermined angle.

As previously explained, since the "on" operations or conductions of the respective switching element groups are switched at predetermined timing in order to change the directions of the currents flowing through the windings of the respective phases, the magnetic field distribution within the motor 10 is changed. As a result, the rotor 10 is caused to repeatedly rotate in a stepwise manner each time by a predetermined angle.

Here, it should also be noted that the motor drive unit 27 is constructed by using ordinary control circuits for the brushless motor, and since the motor drive unit 27 does not constitute any feature of the present invention, a further detailed description thereof is omitted.

Next, control operation of the engine air intake amount control apparatus according to this first embodiment of the present invention will be explained.

First, a learning operation of an intermediate opening degree position of the throttle valve 11 will be explained.

In the engine air intake amount control apparatus 20, when the ignition switch signal is in an "off" state and also the engine revolution speed "Ne" becomes 0, the key switch on/off judging unit 31 judges that the unillustrated key switch is turned off. When a throttle opening degree voltage representative of the opening degree of the throttle valve 11 is in a predetermined opening degree voltage range (for instance, 0.8 V to 1.8 V), the drive or output signal of the motor controller 26 is set to the "off" state or turned off and the throttle valve 11 is returned to the intermediate opening degree position by means of biasing forces exerted from both the return spring 14*a* and the Limp home travelling spring 14*b*. Under such a condition that the throttle valve 11 is located at the intermediate opening degree position with a sufficiently stable condition, an opening degree voltage VS0 outputted from the throttle sensor 13 is stored as an intermediate opening degree position learned value. This stable condition may be actualized, for example, after the lapse of a predetermined time (e.g., 0.5 seconds) from the instant when a change in the opening degree voltage becomes lower than, or equal to, 20 mV at a sampling time period of about 15 ms. After the intermediate opening degree position learning operation is carried out, a rotor magnetic pole position learning operation is commenced. When the intermediate opening degree learning operation has not yet been completed, a transfer from the intermediate degree learning operation to the rotor magnetic pole position learning operation is prohibited.

Next, a description will now be made of a learning operation related to a rotor magnetic pole position.

In the engine air intake amount control apparatus 20, when the ignition switch signal is in an "off" state and also the engine revolution speed "Ne" becomes 0, the key switch on/off judging unit 31 judges that the key switch is turned off. Thereafter, when the learning operation of the throttle intermediate opening degree position is accomplished, the learning operation is advanced to the rotor magnetic pole position learning operation.

The motor controller 26 outputs such a PWM duty value corresponding to a phase current flowing through each of the energizing stator windings 17 to the motor drive unit 27 based upon both a constant PWM duty value (for example, 50%) and an energizing ratio. This constant PWM duty value is used to supply a motor phase current equivalent to a drive torque required to drive the rotor 16 of the brushless motor 18 in a stepwise manner. The energizing ratio is determined by energizing patterns (for instance, 6 different kinds of energizing patterns) supplied from the stepwise drive energizing pattern setting unit 28. Thus, the motor controller 26 instructs that these energizing patterns are sequentially switched in a direction to close the throttle valve 11 from the intermediate opening degree position. With execution of this operation, the rotor 16 of the brushless motor 18 is repeatedly rotated by the stepwise operation (for example, the stepwise operation is executed by a rotor rotation angle of 30 degrees) in response to switching operation of the respective energizing patterns.

A table 1 shown in FIG. 8 represents a relationship among energizing patterns No. 1 to No. 6, magnetic poles produced in the respective phases, and throttle drive directions in the case where the rotor 16 of the 3-phase/4-pole brushless motor 18 is stepwise driven. An energizing phase in which a phase current is supplied to the energizing stator winding 17 is indicated at an S pole (upstream side), whereas an energizing phase in which a phase current is derived from the energizing stator winding 17 is indicated at an N. pole (downstream side).

Figure 4:
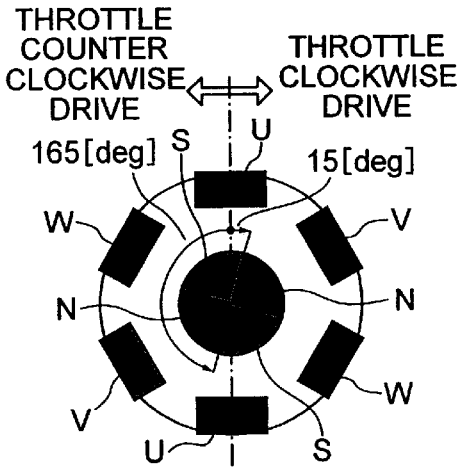
FIG. 4 illustratively shows a positional relationship between a magnetic pole of a stator and a magnetic pole of a rotor in respective energizing patterns used in the air intake amount control apparatus of the invention.
Figure 4:
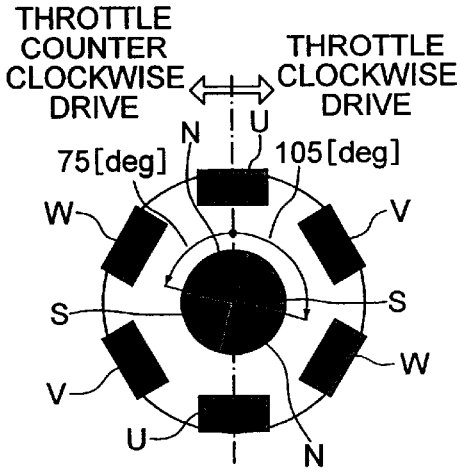
Figure 4:
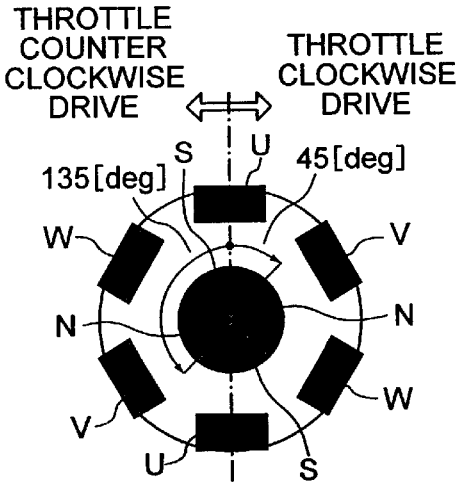
Figure 4:
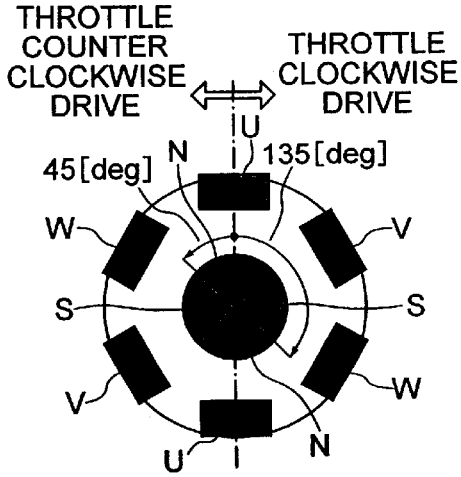
Figure 4:
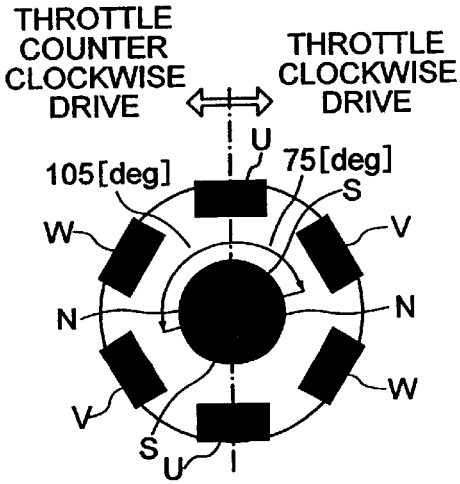
Figure 4:
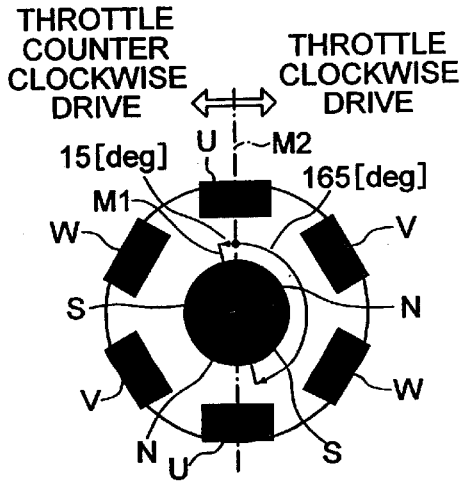

FIG. 4 shows a magnetic pole positional relationship between the stator 17 and the rotor 16 when the stepwise drive positions of the rotor 16 is stepwise rotated in accordance with the respective energizing patterns No. 1 to No. 6 from its intermediate position in which the throttle valve 11 is located at the intermediate opening degree position, in an assembling condition that the positional relationship between the stator and the rotor when the throttle valve 11 is returned to the intermediate opening degree position with the stator winding of the brushless motor 18 being in a de-energized state is such that both a rotor magnetic pole boundary line M1 and a stator U-phase reference line M2 are in coincidence with each other.

In energizing pattern No. 6, the rotor 16 is stepwise driven from the initial assembly position (throttle intermediate opening degree position) by the rotor rotation angle of 15 degrees toward the throttle fully closed direction so that it is thereby positionally defined. Subsequently, in energizing pattern No. 5, the rotor 16 is further stepwise driven to define the rotor 16 at a position rotated by 45 degrees from the initial assembly position. Similarly, when the energizing pattern is sequentially switched from the energizing pattern No. 4 to the energizing pattern No. 1, the rotor 16 is stepwise driven each time by the rotation angle of 30 degrees so as to drive the throttle valve 11 to the fully closed side.

Figure 5:
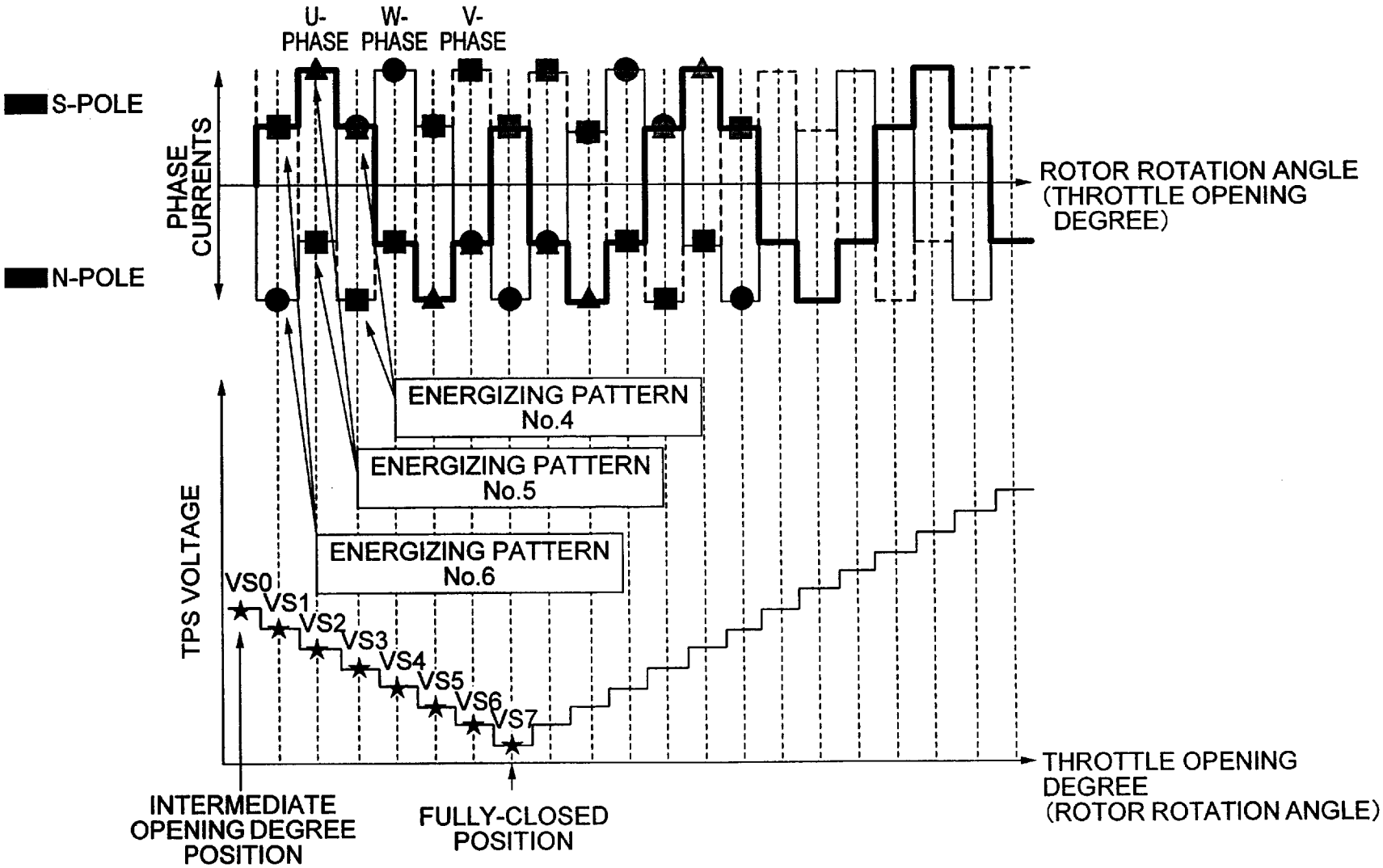
FIG. 5 is an explanatory diagram for explaining energizing patterns in stepwise operations performed by the air intake amount control apparatus of the invention.

FIG. 5 shows a relationship among the respective energizing patterns, the respective phase currents supplied to the respective stator windings U-phase, V-phase and W-phase, the respective phase magnetic pole patterns, stepwise rotational positions of the rotor 16, throttle opening degrees, and TPS voltages in the respective energizing patterns in such a case that the rotor 16 of the brushless motor 18 is driven in the stepwise manner during the rotor magnetic pole position learning operation.

Under a de-energized state, the throttle valve 11 is located at the intermediate opening degree position, and the TPS voltage value indicates the same voltage as the intermediate opening degree voltage learned value VS0. Applying the energizing pattern No. 6, phase currents will flow into the U-phase and the V-phase so as to form an S pole, and a phase current flows from the W-phase so as to form an N. pole, so that the rotor 16 is stepwise driven by attraction forces produced between these N/S poles and the magnetic poles of the rotor 16, and then, the rotor 16 is stopped or defined at a position of a TPS voltage value VS1.

Similarly, applying the energizing pattern No. 5 will cause a phase current to flow into the U-phase so as to form an S pole, and phase currents to flow from the V-phase and the W-phase so as to form an N. pole, respectively, so that the rotor 16 is stepwise driven by attraction forces produced between the N/S poles and the magnetic poles of the rotor 16, and then, the rotor 16 is stopped or defined at a position of a TPS voltage value VS2.

Since the positional relationship between the magnetic pole position of the motor rotor 16 and the stator winding 17 is not adjusted upon assembling, a first stepping operation is not firmly determined. That is, it would be unknown which energizing pattern from the stepwise drive energizing pattern setting unit 28 does commencement of the first stepping operation is based upon. Similarly, a stepwise rotational position of the rotor 16 by the first stepwise driving thereof would vary in accordance with both the assembling positional relationship between the magnetic pole position of the motor rotor 16 and the stator winding 17, as well as with a first energizing pattern (for example, energizing pattern No. 6) of the stepwise drive. That is, it would be impossible to determine whether this stepwise rotational position is either on the fully opened side or the fully closed side from the intermediate opening degree position. As a result, the rotor magnetic pole position learned value storing unit 29 stores therein the magnetic pole position learned value VS1 for the stepwise position located on the fully closed side and nearest to the intermediate opening degree position (intermediate opening degree voltage learned value VS0), and the energizing pattern used to drive the rotor 16 to that position (in this example, energizing pattern No. 6).

Figure 6:
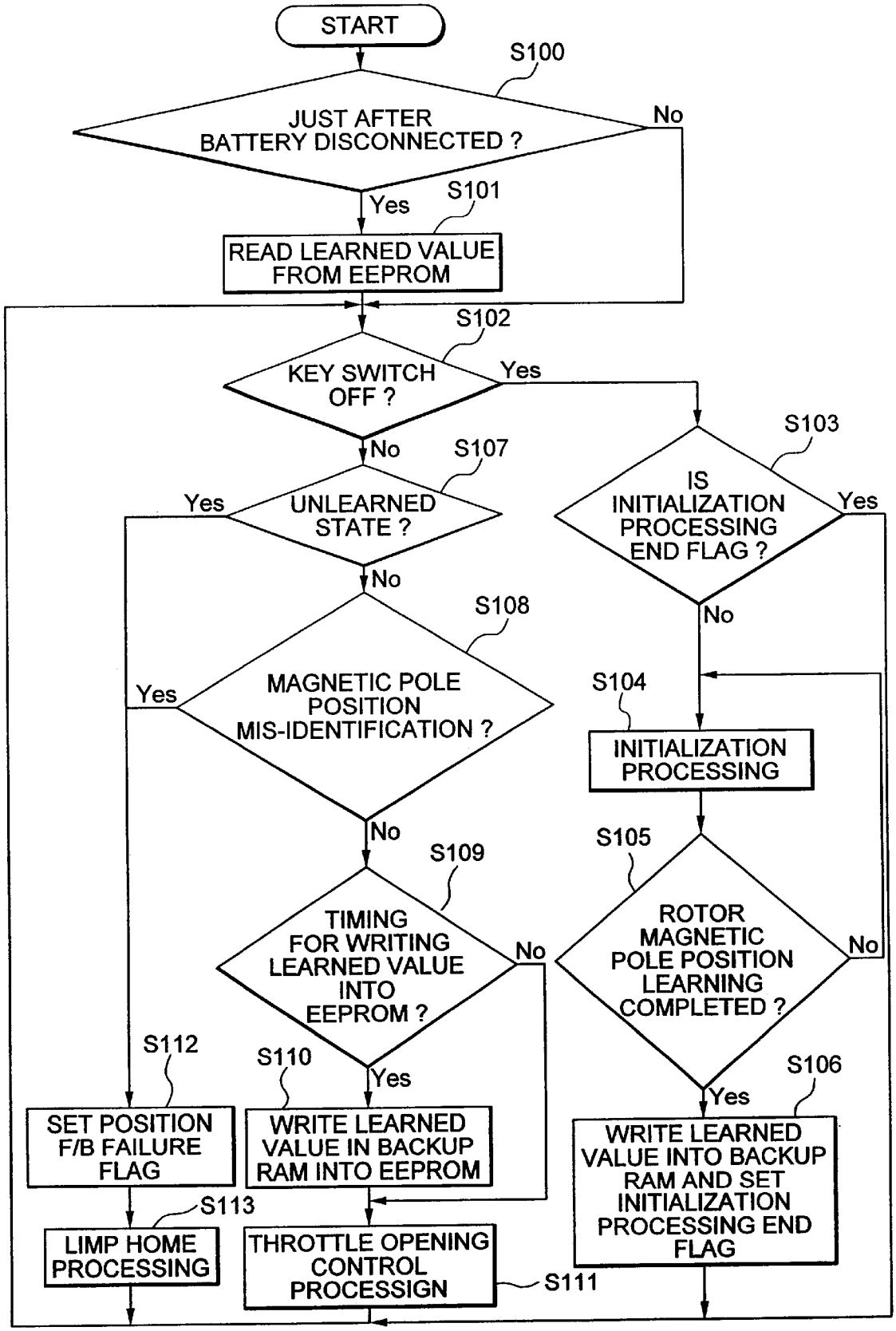
FIG. 6 is a flow chart for describing a rotor stepwise drive control carried out by the air intake amount control apparatus of the invention.

FIG. 6 is a flow chart for showing a throttle intermediate opening degree position learning operation and a rotor magnetic pole position learning operation when the key switch is turned off, and a rotor magnetic pole position identifying or verifying operation executed just after the key switch is turned on.

At a step S101, the key switch on/off judging unit 31 judges, based upon a predetermined value stored in the RAM, as to whether or not the key switch is turned on just after the battery is disconnected. When it is determined that the battery is once disconnected, then at a step S101, the rotor magnetic pole position learned value, the intermediate opening degree position voltage learned value (VS0), the magnetic pole position learned value VS1 of the stepwise position located on the fully closed side and nearest to the intermediate opening degree position, and the energizing pattern used to drive the rotor to that stepwise position (namely, energizing pattern No. 6 in this example) are read from the EEPROM.

When the battery is not disconnected, the key switch on/off judging unit 31 judges as to whether or not the key switch is turned off at a step S102. When it is judged that the key switch is turned off, the control process advances to a step S103 at which an initializing process operation is carried out. When an initializing process end flag is set at step S103, the control process advances to the previous step S102 at which a similar process operation is carried out. To the contrary, when the initializing process end flag is not set, the initializing process of the step S104 is carried out.

In the initializing process of the step 104, the brushless motor 18 is first de-energized, so that the throttle valve opener 12*b* is depressed against the intermediate opening degree position stopper 19*c* by the biasing force F2 of the Limp home travelling spring 14*b* so as to return the throttle valve 11 to the intermediate opening degree position. Then, the learning operation of the intermediate opening degree position voltage (namely, voltage VS0 in FIG. 5) is carried out based upon the output voltage of the throttle sensor 13 after a predetermined time period (for example, 0.5 seconds) has passed in which the throttle opening degree position becomes sufficiently stable.

After the intermediate opening degree position voltage learning operation has been accomplished, the brushless motor 18 is driven in a stepwise manner by sequentially switching the energizing patterns shown in the above-described table 1 from the energizing pattern No. 6 to the energizing pattern No. 1 in the throttle fully-closed direction. Both the magnetic pole position learned value (i.e., VS1 in operation of FIG. 5) in the fully-closed direction, which is the closest to the intermediate opening degree position voltage learned value (VS0 in operation of FIG. 5), and the energizing pattern (i.e., energizing pattern No. 6 in operation of FIG. 5) used to drive the brushless motor 18 to this magnetic pole position are stored into the magnetic pole position learned value storing circuit 29. Also, the rotor 16 of the brushless motor 18 is driven in the stepwise manner to the throttle fully-closed side in accordance with the energizing pattern supplied from the stepwise drive energizing pattern setting unit 28 every predetermined energizing time t1 (for example 75 ms). Then, the respective stepwise positions are stored as the throttle opening degree voltages (VS2, VS3, VS4, - - - ).

When a stepwise position change amount ($|VSn-VSn-1|$) between a preceding stepwise position VSn−1 and a present stepwise position VSn during stepwise drive operation of the rotor 16 is smaller than, or equal to, a predetermined value Vsr, and when the throttle opening degree voltage value is smaller than, or equal to, a predetermined value (for example, 0.7 V), the magnetic pole position identifying unit 30 judges that the throttle valve 11 has reached the fully-closed position, and thus, a stepwise position Vcls (i.e., VS7 in operation of FIG. 5) is stored as a throttle fully-closed position learned value, and also, the above-explained energizing pattern is switched to such an energizing pattern as to open the throttle valve (namely, energizing pattern No. 6 is switched to energizing pattern No. 1, then therefrom to energizing pattern No. 2, - - - , in the example of FIG. 5), the rotor 16 is stepwise driven toward the throttle fully-opened direction and then, the throttle opening degree voltage values at the respective stepwise positions are stored as magnetic pole position learned values.

Furthermore, when a step position change amount (|Vsn−VSn−1|) between a preceding step position VSn−1 and a present step position VSn during stepwise drive operation of the rotor 16 is smaller than, or equal to a predetermined value Vsr, and when the throttle opening degree voltage value is smaller than, or equal to, a predetermined value (for example, 4.0 V), the magnetic pole position identifying unit 30 judges that the throttle valve 11 has reached the fully-opened position, and thus, a stepwise position Vwot (not shown in operation of FIG. 5) is stored as a throttle fully-opened position learned value, and also, the above-explained energizing pattern is switched to such an energizing pattern as to open the throttle valve (namely, if the energizing pattern at the fully-opened position is energizing pattern No. 1, subsequently, the energizing pattern is switched to energizing pattern No. 6, and therefrom to energizing pattern No. 5, - - - , in the example of FIG. 5), the rotor 16 is stepwise driven in the throttle fully-closed direction and then, the throttle opening degree voltage values at the respective stepwise positions are stored as magnetic pole position learned values.

At a step S105, the rotor magnetic pole position learning unit 23 judges as to whether or not the stepwise position during the initializing operation is returned from the throttle intermediate opening degree position via the throttle fully-closed position and the throttle fully-opened position to the throttle intermediate opening degree position (namely, VS0 in operation of FIG. 5). When the stepwise position is not returned to the intermediate opening degree position, the initializing operation at the step S104 is continued. Conversely, when the stepwise position is returned to the intermediate opening degree position, the rotor magnetic pole position learning unit 23 judges that the rotor magnetic pole position learning operation has been completed. Then, the magnetic pole position learned value is written into the back-up RAM at a step S106, and an initializing processing end flag is set. Thereafter, the process operation is advanced to the step S102 at which a similar process operation is carried out.

To the contrary, when the key switch on/off judging unit 31 judges that the key switch is turned on, the rotor magnetic pole position learning unit 23 judges as to whether or not the magnetic pole position learning operation is brought into a non-learning state by checking a flag at a step S107. When this magnetic pole position learning operation is brought into the non-learning state, the process operation at a step S112 is carried out.

In such a case that the magnetic pole position learning operation has been accomplished, then at a step S108, the magnetic pole position identifying unit 30 reads the magnetic pole position learned value from the rotor magnetic pole position learned value storing unit 29, and both the magnetic pole position learned value (i.e., VS1 in operation of FIG. 5) in the fully-closed direction, which is the nearest value with respect to the intermediate opening degree position voltage learned value (VS0 in operation of FIG. 5), and the energizing pattern (i.e., energizing pattern No. 6 in operation of FIG. 5) used to drive the rotor 16 to this magnetic pole position are read out therefrom.

Then, the brushless motor 18 is stepwise driven by using this energizing pattern (i.e., energizing pattern No. 6 in operation of FIG. 5), and in the case that an absolute value deviation between the throttle opening degree voltage VS at the stepwise position at this time and the magnetic pole position learned value (i.e., VS1 in operation of FIG. 5) in the fully-closed direction, which is the nearest value with respect to the intermediate opening degree position voltage learned value (VS0 in operation of FIG. 5), is not less than a predetermined value (for example, 0.1 V), the magnetic pole position identifying unit 30 judges that the magnetic pole position learned value is not coincident with the rotor magnetic pole position of the brushless motor 18.

At a next step S112, since no drive control operation of the throttle valve 11 by the brushless motor 18 is carried out, the supply of the electric power to the brushless motor 18 is interrupted by a relay (not shown), so that the throttle valve 11 is returned to the intermediate opening degree position, and a position F/B malfunction flag is set. Until the key switch is turned off, the throttle opening degree control operation is prohibited, and also a warning light (not shown) is turned on.

Next, at a step S113, a Limp home processing operation is carried out. This Limp home processing operation is to execute such an engine power control (for example, a total number of engine cylinders for combustion is controlled in accordance with an amount of depression of an accelerator pedal) as suitable for the Limp home travel at the throttle valve intermediate opening degree position.

When the magnetic pole position identifying unit 30 judges that the magnetic pole position learned value becomes coincident with the rotor magnetic pole position of the brushless motor 18, the magnetic pole position identifying unit 30 judges, at a step S109, as to whether or not the magnetic pole position learned value is written into the EEPROM, that is, for example, whether or not a total number of initializing processing operations has reached a predetermined number. When it is so judged that the magnetic pole position learned value is written into the EEPROM, another magnetic pole position learned value saved in the back-up RAM is written into the EEPROM at a step S110, and then the normal throttle opening degree control operation, which will be explained later, is carried out at a step S111.

It should be noted that the power supply relay (not shown) corresponds to a relay used to supply electric power to the air intake amount control apparatus for the engine, and it is set to be turned off in a predetermined time period (for example, 7 seconds) after the key switch is turned off.

Embodiment 2

Next, a description will now be made of an engine air intake amount control apparatus according to a second embodiment of the present invention. Both an arrangement and operation of the engine air intake amount control apparatus according to the embodiment are substantially similar to those explained in the above-mentioned first embodiment. However, according to the second embodiment, the above-explained pole position identification of the rotor magnetic pole position identifying unit 30 is prohibited when a battery voltage detection value detected by a battery voltage detecting unit (not shown) is lower than, or equal to, a predetermined voltage value (for example, 10 V), and thus the rotor magnetic pole position identifying unit 30 does not perform the magnetic pole position identifying/judging operations under battery voltage unstable conditions as in starting the engine.

Embodiment 3

Next, a description will now be made of an engine air intake amount control apparatus according to a third embodiment of the present invention. Both an arrangement and operation of the engine air intake amount control apparatus according to the third embodiment are substantially similar to those explained in the above-mentioned first embodiment. However, according to the third embodiment, the above-explained magnetic pole position identifying operation is prohibited when the throttle opening degree voltage immediately after the key switch is turned on is not in a predetermined opening degree voltage range which is determined based upon both a positioning allowance of the intermediate opening degree position stopping mechanism, and a characteristic allowance of the throttle sensor 13.

Next, a description will now be made of the normal throttle opening degree operation executed when the key switch is turned on.

In cases where a magnetic pole position learned value is coincident with a rotor magnetic pole position of the brushless motor 18 as a result of a rotor magnetic pole position identifying operation being performed when the key switch is turned on, the target opening setting unit 21 sets a target throttle opening degree "$\theta_0$" suitable for various sorts of vehicle information such as an accelerator opening degree, an engine revolution number (rpm), a vehicle speed, etc. Then, the motor current calculating unit 22 calculates an opening degree deviation "$\Delta\theta$" in accordance with the following formula (1). The calculated opening degree deviation is entered into the motor controller 26. This opening degree deviation "$\Delta\theta$" is equal to a difference between the actual throttle opening degree "$\theta_r$" acquired from the throttle sensor (TPS) 13, and the target throttle opening degree "$\theta_0$".

$$\Delta\theta=\theta_0-\theta_r \tag{1}$$

The motor current calculating unit 22 performs a motor current control operation as follows. That is, when the opening degree deviation $\Delta\theta$ is plus, the actual throttle valve opening degree is smaller than the target opening degree, so that the motor current calculating unit 22 increases the phase current of the brushless motor 18. On the other hand, when the opening degree deviation $\Delta\theta$ is minus, the actual throttle valve opening degree exceeds the target opening degree, so that the motor current calculating unit 22 decreases the phase current of the brushless motor 18.

When a motor phase current is calculated from the opening degree deviation $\Delta\theta$, a PID control device is usually used.

A motor phase current Im calculated by this PID control device is expressed by the following formula (2), and thus, the PID control device is operated to control the phase current in such a manner that the opening degree deviation $\Delta\theta$ becomes zero. Then, the motor phase current Im calculated by the above-described manner is input to the motor controller 26:

$$Im=K_P\cdot\Delta\theta+K_I\cdot\Sigma\Delta\theta dt+K_P\cdot\Delta\theta\div dt \tag{2}$$

where:

symbol "Im" represents a PID-calculated motor phase current;

symbol "$K_P$" represents a proportional gain;

symbol "$K_r$" represents an integral gain; and symbol "$K_D$" represents a differential gain.

Also, the rotor rotation angle calculating unit 24 calculates a rotor rotation angle or a rotational angle of the rotor 16 based upon a throttle valve opening degree output signal and a rotor magnetic pole position learned value, and the motor energizing phase calculating unit 25 separately calculates the energizing ratio of the respective energizing stator windings 17 based upon the rotor rotation angle acquired from the rotor rotation angle detecting unit 24. The motor controller 26 calculates a PWM duty value equivalent to a current Is flowing through each of the energizing stator windings 17 based on both the current value Im derived from the motor phase current calculating unit 22 and the energizing ratio obtained from the motor energizing phase calculating unit 25. Then, the motor controller 26 supplies the calculated PWM duty ratio to the motor drive unit 27.

The motor drive unit 27 controls to turn on and off the relevant switching element in response to the PWM duty drive signal equivalent to the current IS of each of the energizing stator windings 17, so that a current may be supplied to a desired phase.

Next, a three-phase energizing system will be explained.

Figure 7:
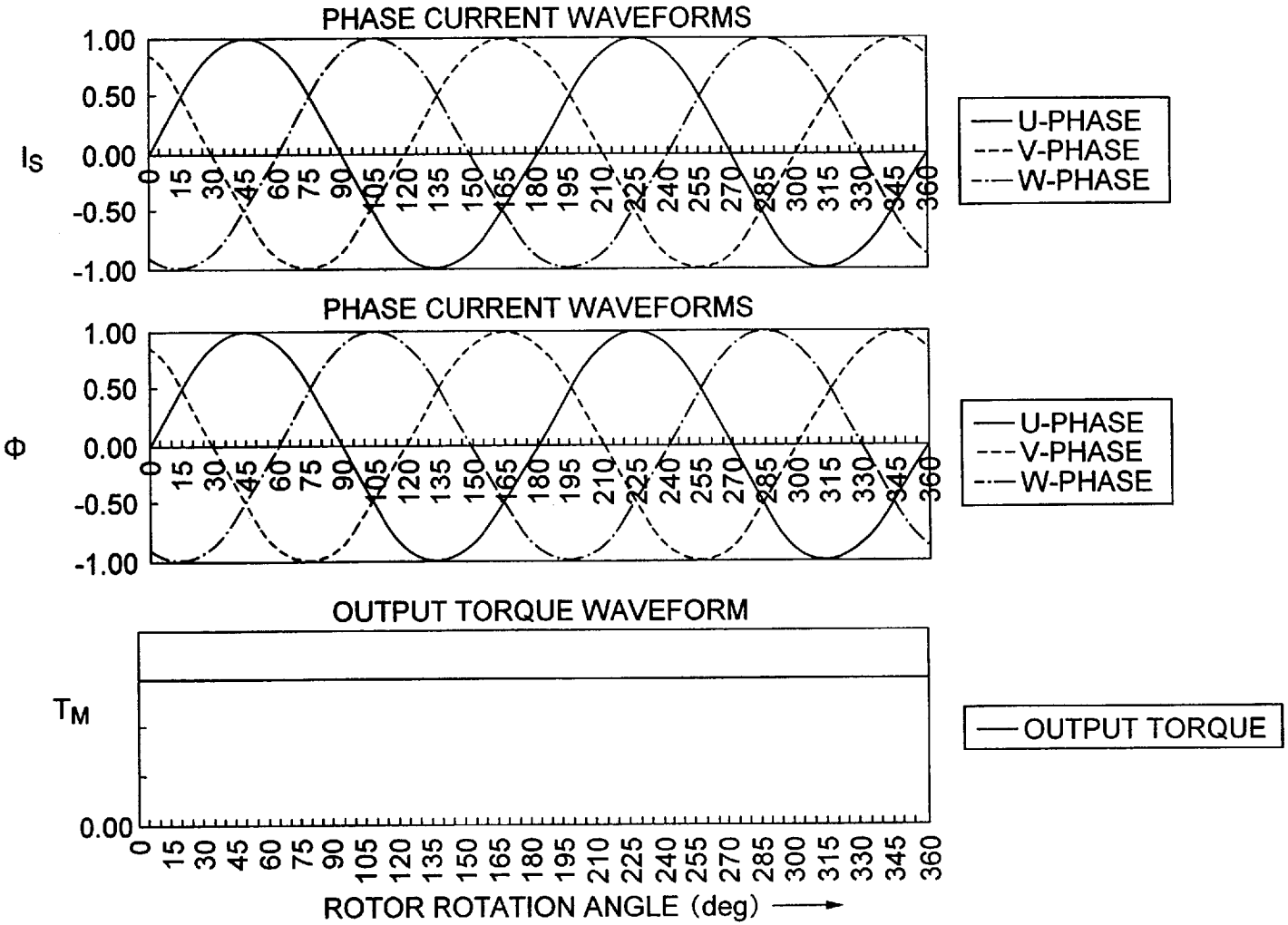
FIG. 7 represents a relationship among a current, a magnetic flux, and torque in each phase of a sine wave energizing system employed in the air intake control apparatus of the invention.

FIG. 7 is a diagram representing a relationship among the respective phase currents, a magnetic flux, and torque in a sine wave energizing system. In this drawing, at the instant when the respective windings are intersected with the magnetic flux of the sine wave by rotating a rotor of a brushless motor, if a sinusoidal current Is, which has the same phase as that of magnetic flux density "$\Phi$" and has a similar waveform, is supplied to each phase, then torque "Ts" produced in each phase by this energization may be expressed by the following formula (3):

$$Ts=K\times\theta\times Is \tag{3}$$

where:

symbol "K" denotes a constant.

The rotor torque of the brushless motor is expressed as a synthesized torque obtained by synthesizing the torque Ts generated in the U-phase, the torque Ts produced in the V-phase, and the torque Ts generated in the W-phase. Theoretically, an output torque having no torque ripple component with respect to the rotor rotation angle may be obtained.

The above-explained energizing system is referred to as a sine wave energizing system. In general, since the energizing currents supplied to the respective phases must be changed in the sine wave form with respect to the rotor rotation angle, this rotor rotation angle need be precisely detected. That is, according to this embodiment, the sine wave energizing system may be actualized by employing both the rotor magnetic pole position learned value and the output signal of the throttle valve opening degree sensor.

Also, a relationship between the PWM duty values and the rotor rotation angles may be expressed by the following formulae (4), (5), and (6):

$$PWM\text{duty } 1=PWM\text{duty}\times\sin 2\gamma \tag{4}$$

$$PWM\text{duty } 2=PWM\text{duty}\times\sin 2(\gamma-60^\circ) \tag{5}$$

$$PWM\text{duty } 3=PWM\text{duty}\times\sin 2(\gamma+60^\circ) \tag{6}$$

$\gamma$: rotor rotation angle.

As described in the foregoing, in accordance with the present invention, an air intake amount control apparatus for an engine is equipped with a throttle valve mounted on a rotation shaft in an air intake passage of the engine, a motor having a rotor coupled to the rotation shaft and having stationary windings, and a throttle sensor for sensing the opening degree of the throttle valve. The throttle valve is controlled by the motor based upon various sorts of vehicle or engine operating information. The engine air intake amount control apparatus further includes: a rotor magnetic pole position learning unit for driving the motor in a stepwise manner so as to learn a magnetic pole position of the rotor detected by the throttle sensor; a rotor magnetic pole position learned value storing unit for storing therein the magnetic pole position of the rotor learned by the rotor magnetic pole position learning unit as a rotor magnetic pole position learned value; and a magnetic pole position identifying unit for, by means of predetermined stepwise driving of the motor, identifying the magnetic pole position learned value stored in the rotor magnetic pole position learned value storing unit with the magnetic pole position of the motor detected by the throttle sensor. When a key switch is turned on, the magnetic pole position learned value stored in the air intake amount control apparatus is identified with the magnetic pole position of the throttle actuator. The air intake amount control apparatus judges as to whether or not the throttle control can be performed on the basis of the identification judgement result, and then controls the engine power in accordance with the judgement result of the throttle control operation. As a result, the following effects can be achieved. That is, even when the engine is started after replacement of components such as a throttle actuator and the like without performing the rotor magnetic pole position learning operation, the air intake amount control apparatus can control the engine power in a proper manner and can maintain the safety drive operation.

According to the present invention, since a magnetic pole position learning operation by the rotor magnetic pole position learning unit is performed when the key switch is turned off, a rotor magnetic pole position learning operation during when the engine is driven can be prevented, and hence various dangerous conditions such as, for example, an abnormal increase in the engine rotational speed, an abnormal acceleration of the vehicle, etc. can be avoided.

According to the present invention, since a magnetic pole position identifying operation of the rotor magnetic pole position identifying unit is performed when the key switch is turned on, it is possible to confirm as to whether or not the throttle control operation is available before starting the engine, and also the engine power can be controlled in a proper manner in accordance with available/non-available conditions of the throttle control operation. As a result, the safety drive operation can be carried out.

According to the present invention, the air intake amount control apparatus further includes an intermediate opening degree stopping mechanism for setting the throttle opening degree position to an intermediate opening degree position under such a condition that the motor is in a de-energized state when the key switch is turned on, in which a magnetic pole position identifying operation of the rotor magnetic pole position identifying unit is carried out by driving the rotor in a stepwise manner from an intermediate opening degree position to a first rotor magnetic pole position learning position in a throttle fully-closed direction. As a result, the magnetic pole position identifying operation can be carried out within a short time period.

According to the present invention, the rotor magnetic pole position identifying unit judges that the rotor magnetic pole position learned value stored in the rotor magnetic pole position learned value storing unit is not coincident with the magnetic pole position of the motor if a deviation between a first rotor magnetic pole position learned value and a second rotor magnetic pole position detected by the throttle sensor when the rotor is stepwise driven to a predetermined rotor magnetic pole position learning position upon turning on of the key switch is larger than, or equal to, a predetermined value. As a result, there is such an effect that it can immediately confirm as to whether or not the throttle control operation is available when the key switch is turned on.

According to the present invention, when the rotor magnetic pole position identifying unit judges that the rotor magnetic pole position learned value is not coincident with the magnetic pole position of the motor, the rotor magnetic pole position identifying unit prohibits the execution of the throttle opening degree control operation until the key switch is turned off, judges that a position feedback failure happens to occur, gives a warning, and sets the throttle opening degree to an intermediate opening degree position. As a result, incapability of the throttle control can be warned to the vehicle driver, and also the speed of the vehicle may be slowed down while securing safety in driving.

According to the present invention, when the battery voltage is lower than, or equal to, a predetermined value, the magnetic pole position identifying operation is prohibited. Thus, it is possible to avoid erroneous judgements on the magnetic pole position identification under low battery voltage.

According to the present invention, the magnetic pole position identifying operation is prohibited in the case where the throttle opened-degree position immediately after the key switch is turned on is not in a predetermined value range. Consequently, even when the throttle value is mechanically locked, there is no risk of erroneously judging the magnetic pole position identification.

According to the present invention, when the rotor magnetic pole position learning operation is not performed, the rotor magnetic pole position identifying unit prohibits the execution of the magnetic pole position identifying operation, prohibits the throttle opening degree control operation until the key switch is turned off, judges that a position feedback failure happens to occur, gives a warning, and sets the throttle opening degree to the intermediate opening degree position. As a result, in capability of the throttle control can be warned to the vehicle driver, and also the speed of the vehicle may be slowed down while securing safety in driving.

According to the present invention, the rotor magnetic pole position learned value storing unit is provided with a volatile memory being energized by a battery to hold a storage operation, and a non-volatile memory. When the key switch is turned on under such a condition that the battery is not disconnected from the volatile memory, the rotor magnetic pole position identifying unit executes the rotor magnetic pole position identifying operation by using the magnetic pole position learned value stored in the volatile memory, whereas when the key switch is turned on just after the battery is disconnected from the volatile memory, the rotor magnetic pole position identifying unit executes the rotor magnetic pole position identifying operation by using the magnetic pole position learned value stored in the non-volatile memory. As a result, there is such a merit that the magnetic pole position identification can be firmly carried out.

According to the present invention, the rotor magnetic pole position learning unit learns the fully-closed position of the throttle valve based upon the voltage value outputted from the throttle sensor when the voltage value outputted from the throttle sensor upon the rotor being stepwise driven from the throttle intermediate opening degree position in the throttle fully-closed direction is smaller than, or equal to, a predetermined voltage value, and when a deviation between the voltage value outputted from the throttle sensor at the preceding stepwise position of the throttle valve and the voltage value outputted from the throttle sensor at the present stepwise position of the throttle valve is smaller than, or equal to, the predetermined value. As a result, the fully-closed position of the throttle valve can be easily learned, and the throttle fully-close instruction value when the target opening degree is set can be made correct, so that unnecessary current applications to the motor can be avoided.

According to the present invention, the rotor magnetic pole position learning unit learns the fully-opened position of the throttle valve based upon the voltage value outputted from the throttle sensor when the voltage value outputted from the throttle sensor upon the rotor being stepwise driven from the throttle fully-closed position in a throttle fully-opened direction is greater than, or equal to a predetermined voltage value, and when a voltage deviation between the voltage value outputted from the throttle sensor at the preceding stepwise position of the throttle valve and the voltage value outputted from the throttle sensor at the present stepwise position of the throttle valve is smaller than, or equal to, the predetermined value. Thus, the fully-opened position of the throttle valve can be easily learned, and the throttle fully-opened instruction value when a target opening degree is set can be made correct, so that unnecessary current applications to the motor can be avoided.

According to the present invention, in the course of the magnetic pole position learning operation, when either the fully-closed or fully-opened position of the throttle valve is detected, the stepwise driving direction is reversed by switching energizing patterns. Thus, an engine detuning operation can be avoided which would otherwise be caused when the throttle valve abuts against a throttle fully-closed/fully-opened stopper while the rotor is stepwise driven, and also the magnetic pole position learning operation can be firmly carried out.

What is claimed is:

1. An air intake amount control apparatus for an engine, comprising:

a throttle valve mounted on a rotation shaft in an intake passage of said engine;

a throttle sensor for sensing an opening degree of said throttle valve;

a motor having a rotor coupled to said rotation shaft for driving said throttle valve based upon engine operating information;

a rotor magnetic pole position learning unit for driving said motor in a stepwise manner so as to learn a magnetic pole position of said rotor that is detected by said throttle sensor;

a rotor magnetic pole position learned value storing unit for storing therein said magnetic pole position of said rotor learned by said rotor magnetic pole position learning unit as a magnetic pole position learned value;

a magnetic pole position identifying unit for driving said motor to a predetermined stepwise position so as to identify said magnetic pole position learned value stored in said rotor magnetic pole position learned value storing unit with the magnetic pole position of said motor at said predetermined stepwise position detected by said throttle sensor, and a key switch on/off judging unit for judging whether a key switch is turned on or off, wherein when said rotor magnetic pole position identifying unit judges that the rotor magnetic pole position learned value is not coincident with the magnetic pole position of said motor detected by said throttle sensor, said rotor magnetic pole position identifying unit prohibits execution of a throttle opening degree control operation until the key switch is turned off.

2. The air intake amount control apparatus for an engine as claimed in claim 1, wherein a magnetic pole position learning operation of said rotor magnetic pole position learning unit is performed when said key switch on/off judging unit judges that the key switch is turned off.

3. The air intake amount control apparatus for an engine as claimed in claim 1, wherein a magnetic pole position identifying operation of said rotor magnetic pole position identifying unit is performed when said key switch on/off judging unit judges that the key switch is turned on.

4. The air intake amount control apparatus for an engine as claimed in claim 1, further comprising an intermediate opening degree stopping mechanism for setting the opening position of said throttle valve to an intermediate opening degree position under such a condition that said motor is not energized when said key switch on/off judging unit judges that the key switch is turned on, wherein a magnetic pole position identifying operation of said rotor magnetic pole position identifying unit is carried out by driving said rotor in a stepwise manner from the intermediate opening degree position to a first rotor magnetic pole position learning position in a throttle fully-closed direction.

5. The air intake amount control apparatus for an engine as claimed in claim 3, wherein said rotor magnetic pole position identifying unit judges that the rotor magnetic pole position learned value stored in said rotor magnetic pole position learned value storing unit is not coincident with the magnetic pole position of said motor if a deviation between the rotor magnetic pole position learned value and the rotor magnetic pole position detected by said throttle sensor when said rotor is stepwise driven to a predetermined rotor magnetic pole position learning position upon turning on of the key switch is larger than, or equal to, a predetermined value.

6. The air intake amount control apparatus for an engine as claimed in claim 4, wherein said rotor magnetic pole position identifying unit judges that the rotor magnetic pole position learned value stored in said rotor magnetic pole position learned value storing unit is not coincident with the magnetic pole position of said motor if a deviation between the rotor magnetic pole position learned value and the rotor magnetic pole position detected by said throttle sensor when said rotor is stepwise driven to a predetermined rotor magnetic pole position learning position upon turning on of the key switch is larger than, or equal to, a predetermined value.

7. The air intake amount control apparatus for an engine as claimed in claim 5, wherein when said rotor magnetic pole position identifying unit judges that the rotor magnetic pole position learned value is not coincident with the magnetic pole position of said motor detected by said throttle sensor, said rotor magnetic pole position identifying unit judges that a position feedback failure happens to occur, gives a warning, and sets the throttle opening degree to the intermediate opening degree position.

8. The air intake amount control apparatus for an engine as claimed in claim 6, wherein when said rotor magnetic pole position identifying unit judges that the rotor magnetic pole position learned value is not coincident with the magnetic pole position of said motor detected by said throttle sensor, said rotor magnetic pole position identifying unit judges that a position feedback failure happens to occur, gives a warning, and sets the throttle opening degree to the intermediate opening degree position.

9. The air intake amount control apparatus for an engine as claimed in claim 1, wherein a magnetic pole position identifying operation of said rotor magnetic pole position identifying unit is prohibited when a battery voltage is lower than, or equal to, a predetermined value.

10. The air intake amount control apparatus for an engine as claimed in claim 1, wherein a magnetic pole position identifying operation of said rotor magnetic pole position identifying unit is prohibited when the opening position of said throttle valve is without a predetermined range immediately after said key switch on/off judging unit judges that the key switch is turned on.

11. The air intake amount control apparatus for an engine as claimed in claim 3, wherein when said rotor magnetic pole position learning operation is not yet performed, said rotor magnetic pole position identifying unit prohibits the execution of the throttle opening degree control operation, prohibits the throttle opening degree control operation until the key switch is turned off, judges that a position feedback failure happens to occur, gives a warning, and sets the throttle opening degree to the intermediate opening degree position.

12. The air intake amount control apparatus for an engine as claimed in claim 4, wherein when said rotor magnetic pole position learning operation is not yet performed, said rotor magnetic pole position identifying unit prohibits the execution of the throttle opening degree control operation, prohibits the throttle opening degree control operation until the key switch is turned off, judges that a position feedback failure happens to occur, gives a warning, and sets the throttle opening degree to the intermediate opening degree position.

13. The air intake amount control apparatus for an engine as claimed in claim 1, wherein said rotor magnetic pole position learning unit learns a fully-closed position of said throttle valve based upon the voltage value outputted from said throttle sensor when a voltage value outputted from said throttle sensor upon said rotor being stepwise driven from said throttle intermediate opening degree position in a throttle fully-closed direction is smaller than, or equal to, a predetermined voltage value, and when a deviation between a first voltage value outputted from said throttle sensor at a preceding stepwise position of said throttle valve and a second voltage value outputted from said throttle sensor at a present stepwise position of said throttle valve is smaller than, or equal to, a predetermined value.

14. The air intake amount control apparatus for an engine as claimed in claim 1, wherein said rotor magnetic pole position learning unit learns a fully-opened position of said throttle valve based upon the voltage value outputted from said throttle sensor when a voltage value outputted from said throttle sensor upon said rotor being stepwise driven from said throttle fully-closed opening degree position in a throttle fully-opened direction is greater than, or equal to, a predetermined voltage value, and when a deviation between a first voltage value outputted from said throttle sensor at a preceding stepwise position of said throttle valve and a second voltage value outputted from said throttle sensor at a present stepwise position of said throttle valve is smaller than, or equal to, a predetermined value.

15. The air intake amount control apparatus for an engine as claimed in claim 13, wherein when said throttle sensor detects either the fully-closed position or the fully-opened position of said throttle valve, the direction in which said rotor is stepwise driven is reversed by switching over energizing patterns.

16. The air intake amount control apparatus for an engine as claimed in claim 14, wherein when said throttle sensor detects either the fully-closed position or the fully-opened position of said throttle valve, the direction in which said rotor is stepwise driven is reversed by switching over energizing patterns.

17. An air intake amount control apparatus for an engine, comprising:

a throttle valve mounted on a rotation shaft in an intake passage of said engine;

a throttle sensor for sensing an opening degree of said throttle valve;

a motor having a rotor coupled to said rotation shaft for driving said throttle valve based upon engine operating information;

a rotor magnetic pole position learning unit for driving said motor in a stepwise manner so as to learn a magnetic pole position of said rotor that is detected by said throttle sensor;

a rotor magnetic pole position learned value storing unit for storing therein said magnetic pole position of said rotor learned by said rotor magnetic pole position learning unit as a magnetic pole position learned value;

a magnetic pole position identifying unit for driving said motor to a predetermined stepwise position so as to identify said magnetic pole position learned value stored in said rotor magnetic pole position learned value storing unit with the magnetic pole position of said motor at said predetermined stepwise position detected by said throttle sensor, and a key switch on/off judging unit for judging whether a key switch is turned on or off, wherein said rotor magnetic pole position learned value storing unit comprises:

an EEPROM being energized by a battery to hold a storage operation; and a non-volatile RAM; and wherein when said key switch on/off judging unit judges that the key switch is turned on with the battery having not been disconnected from said EEPROM, said rotor magnetic pole position identifying unit executes a rotor magnetic pole position identifying operation by using a magnetic pole position learned value stored in said EEPROM, whereas when said key switch on/off judging unit judges that the key switch is turned on just after the battery is disconnected from the EEPROM, said rotor magnetic pole position identifying unit executes a rotor magnetic pole position identifying operation by using the magnetic pole position learned value stored in said non-volatile RAM.

* * * * *